US011846408B2

(12) United States Patent
Rose et al.

(10) Patent No.: US 11,846,408 B2
(45) Date of Patent: Dec. 19, 2023

(54) MOUNTABLE DEVICE AND METHOD

(71) Applicant: ZUMA ARRAY LIMITED, London (GB)

(72) Inventors: Ed Rose, London (GB); Morten Warren, Oxshott (GB); Stephen De Saulles, London (GB)

(73) Assignee: Zuma Array Limited, London (GB)

( * ) Notice: Subject to any disclaimer, the term of this patent is extended or adjusted under 35 U.S.C. 154(b) by 0 days.

(21) Appl. No.: 17/295,117

(22) PCT Filed: Nov. 19, 2019

(86) PCT No.: PCT/GB2019/053276
§ 371 (c)(1),
(2) Date: May 19, 2021

(87) PCT Pub. No.: WO2020/104791
PCT Pub. Date: May 28, 2020

(65) Prior Publication Data

US 2022/0003392 A1 Jan. 6, 2022

(30) Foreign Application Priority Data

Nov. 19, 2018 (GB) ..... 1818840
Mar. 5, 2019 (GB) ..... 1902952

(51) Int. Cl.
*F21V 21/04* (2006.01)
*F21S 8/02* (2006.01)
*H04R 1/02* (2006.01)

(52) U.S. Cl.
CPC ..... *F21V 21/044* (2013.01); *F21S 8/026* (2013.01); *H04R 1/026* (2013.01); *H04R 2201/021* (2013.01)

(58) Field of Classification Search
CPC ..... F21V 21/044; F21S 8/026; H04R 1/026; H04R 2201/021
See application file for complete search history.

(56) References Cited

U.S. PATENT DOCUMENTS 6,016,596 A 1/2000 Rodgers
8,465,182 B1 * 6/2013 Davis ..... F21V 21/042 362/396
10,182,279 B1 * 1/2019 Zhou ..... F21S 6/005

FOREIGN PATENT DOCUMENTS

CN 104165311 11/2014
GB 2486498 6/2012
(Continued)

OTHER PUBLICATIONS

International Search Report and the Written Opinion dated Jan. 8, 2020 From the International Searching Authority Re. Application No. PCT/GB2019/053276. (12 Pages).
(Continued)

*Primary Examiner* — Andrew L Sniezek

(57) ABSTRACT

A device suitable for mounting in a ceiling aperture in a ceiling is provided. The device comprises a body having a front end and defining a longitudinal axis perpendicular to the front end. The device further comprises a flange that extends laterally beyond the body at the front end. The device further comprises one or more elastic members mounted on the body, each elastic member being configurable in a restrained position and an engaging position. The device further comprises a respective guide on the body associated with each elastic member, each guide being configured to receive a restraining member that urges the respective elastic member into the restrained position when the restraining member is inserted into the guide, and wherein the respective elastic member is released into the engaging position when the restraining member is removed
(Continued)

from the guide, wherein each elastic member extends laterally beyond the body in the engaging position.

19 Claims, 14 Drawing Sheets

(56) References Cited

FOREIGN PATENT DOCUMENTS

| | | |
|---|---|---|
| JP | 57-45712 | 3/1982 |
| WO | WO 2012/091660 | 7/2012 |
| WO | WO 2020/104791 | 5/2020 |

OTHER PUBLICATIONS

Patents Act 1977: Examination Report Under Section 18(3) dated Sep. 16, 2020 From the Intellectual Property Office of the United Kingdom of Great Britain Re. Application No. GB1902952.9. (2 Pages).
Patents Act 1977: Search Report Under Section 17(5) dated Aug. 19, 2019 From the Intellectual Property Office of the United Kingdom of Great Britain Re. Application No. GB1902952.9. (3 Pages).
Notification of Office Action and Search Report dated Sep. 28, 2022 From the National Intellectual Property Administration of the People's Republic of China Re. Application No. 201980088477.0 and Its Tranlsation Into English. (18 Pages).
Notification of Office Action and Search Report dated Apr. 14, 2023 From the State Intellectual Property Office of the People's Republic of China Re. Application No. 01980088477.0 and Its Translation of Office Action Into English. (19 Pages).

* cited by examiner

MOUNTABLE DEVICE AND METHOD

RELATED APPLICATIONS

This application is a National Phase of PCT Patent Application No. PCT/GB2019/053276 having International filing date of Nov. 19, 2019, which claims the benefit of priority of United Kingdom Patent Application Nos. 1818840.9 filed on Nov. 19, 2018 and 1902952.9 filed on Mar. 5, 2019. The contents of the above applications are all incorporated by reference as if fully set forth herein in their entirety.

FIELD AND BACKGROUND OF THE INVENTION

This invention relates to a device including a mechanism for mounting the device and a method for mounting such a device.

Recessed ceiling fittings (such as LED fittings) are generally mounted in a ceiling void using some form of torsion spring, a pair of ramped blades or other biasing means.

FIG. 1 provides an illustration of a prior art ceiling fitting. As can be seen from FIG. 1, the fitting is provided with a body and a constant force spring on either side of the fitting. Generally, the principle is that the installer partly unfurls the two springs using their fingers to the point at which the body of the fitting tapers. The overall width of the fitting and springs is thereby reduced. The user then inserts the body of the fitting and both springs through the hole in the ceiling. When the springs are released, they roll up under their own bias and hold the fitting in place. Manually unrolling the springs in this way is possible because the springs have a light spring force as they only need to retain a lightweight lamp.

Some ceiling mounted devices require holding in place with more force than a lightweight lamp. This may be because the devices themselves are heavier. Additional force may also be required to hold a device that vibrates. If the prior art system is adapted to include a constant force spring applying a greater force then it may not be possible for the user to unfurl the spring with their fingers. Attempting to do so could cause an injury.

An object of the present invention is therefore to provide an improved system for mounting a device in a ceiling where more force can be applied to hold the device in place.

SUMMARY OF THE INVENTION

The scope of the present invention is defined in the claims. A number of example embodiments are also provided below.

In one example, a device suitable for mounting in a ceiling aperture in a ceiling is provided. The device comprises a body having a front end and defining a longitudinal axis perpendicular to the front end. The device further comprises a flange that extends laterally beyond the body at the front end. The device further comprises one or more elastic members mounted on the body configurable in a restrained position and an engaging position. The device further comprises a respective guide on the body associated with each elastic member. Each guide is configured to receive a restraining member that urges the respective elastic member into the restrained position when the restraining member is inserted into the guide. The respective elastic member is released into the engaging position when the restraining member is removed from the guide. Each elastic member extends laterally beyond the body in the engaging position.

Providing one or more elastic members that are restrained with restraining members allows the device to be inserted easily into a ceiling aperture. This is because the elastic members have a low profile when they are held in the restrained position by the restraining members. Once the device has been inserted into the ceiling aperture, the restraining members can be released and the elastic members will engage with the ceiling to hold the device in the aperture. There is no requirement for the user to manually manipulate the elastic members. The user only needs to remove the one or more restraining members from the guides. The device can therefore be installed easily and safely. Moreover, the device can be removed easily by inserting restraining members back into the guides.

Advantageously, the present invention provides a system that allows a parallel sided body of almost the same dimension as the aperture to be retained in the aperture. The body of the device can be any depth (as long as it fits in the ceiling void). This provides significant advantages over the prior art as much larger devices may be mounted in the ceiling than was possible with prior art systems.

The elastic members may not extend laterally beyond the restraining member in the restrained position. Restraining members and elastic members therefore have a low profile on the body when the elastic members are in the restrained position. The device can therefore be inserted into an aperture in the ceiling that is not much larger than the body of the device.

Each guide may comprise a channel along the body. Each channel may extend from the front end of the body in the longitudinal direction. Each channel may be configured to receive the respective restraining member. Each elastic member may be mounted in the channel of the respective guide. Each elastic member may lie in the respective channel so that it does not extend laterally beyond the body in the restrained position.

Each guide may comprise a pair of channels along the body. Each channel may extend from the front end of the body in the longitudinal direction. The channels in each pair of channels may be located on either side of the respective elastic member. Each channel in each pair of channels may be configured to receive a portion of the respective restraining member.

Each channel may be a retention channel comprising an overhanging portion on one or both sides of the channel. The overhanging portion may be configured to retain the restraining member in the channel when the restraining member is inserted into the channel. For example, the retention channel may be a "T-slot". The profiled retention channel provides support to the restraining member so that the restraining member is retained against the body whilst applying a force to the elastic member to move the elastic member to (and keep the elastic member in) the restrained position.

Each channel may be formed as an integral part of the body of the device. Alternatively, each channel may be external to the body of the device. If each channel is formed as an integral part of the body, and each elastic member is fastened in a channel, then the mounting system may not protrude laterally from the body of the device at all when the elastic members are in the restrained position. However, this is not essential and the channel may be formed separately (for example as a thin external track) and attached to the outside of the body of the device. Such a system would provide a small increase in the width of the device but would still have a low profile compared to the elastic member in the engaging position. Placing the elastic members in the restrained position would therefore enable the device to be inserted easily into the ceiling aperture.

Each guide may comprise one or more magnetic portions on the body of the device.

Each guide may be configured to receive a restraining member comprising one or more magnets. Each of the magnetic portions may be attracted to a respective magnet when the restraining member is inserted into the guide.

The device may be configured so that in use, when the body of the device is inserted in the ceiling aperture and each restraining member is removed from the respective guide, each elastic member engages a rear side of the ceiling and exerts a force against the ceiling in the longitudinal direction. The flange may extend laterally beyond the ceiling aperture to engage a front side of the ceiling and exert a force against the ceiling in a direction opposite the direction of the force exerted by the elastic members to brace the device against the ceiling.

The device may comprise two or more elastic members and respective guides. Where the device comprises two or more guides, the elastic members may be arranged symmetrically (or evenly) around the device. Alternatively, the elastic members may be distributed in a non-symmetric manner to correspond with any potential off-centre mass in the retained body. This provides balanced support of the device so that the device is held securely in the ceiling aperture. The device may comprise three or four elastic members and these may be distributed in multiple orientations per side.

Each elastic member may be a constant force spring (CF spring). For example, the elastic member may be an extension type constant force spring. CF springs can beneficially provide a constant force, regardless of the displacement of the spring. The force used to hold the device is place is therefore determined only by the characteristics of the spring. The thickness of the ceiling does not affect the force applied by the spring.

Moreover, constant force springs can be unrolled into a restrained position in which they have a low profile. This enables the device to be inserted into an aperture only slightly larger than the body to be retained. When the constant force springs are released, they roll up under their own bias. This means that the springs will stand proud of the device on which they are mounted. Thus the constant force springs engage with the upper surface of the ceiling when in use.

The device may be a lighting device including a lighting element. The device may be an audio device including a loudspeaker. Audio devices vibrate when in use and therefore more force may be required to mount such devices in the ceiling. In particular, it is desirable to retain the body of the device static relative to the panel in which it is mounted, despite movement or vibration caused by vibrating or moving elements in the device. Typically, forces 2 to 3 times the weight of the device or greater are desirable. Ideally the force is as high as is practical in order to provide a rigid clamping force to resist vibration and/or resonance.

Advantageously, by mounting the device using an elastic member, vibrations can be dampened. This can help to reduce loosening of physical static fixtures on the device. For example, screws in a speaker can sometimes be loosened by vibration of the speaker. By dampening the vibration of the device, the elastic members can help to prevent components in the device coming loose.

The device may further comprise a respective screw, rivet, pin or fastener used to fasten (i.e. retain or fix) the elastic member to the body. In some examples, the elastic member is fastened in the channel. The screw (or rivet etc.) may be located at or towards the front end of the body. Mounting the elastic member close to the front of the device may allow the restraining member to be inserted into the guide easily. Moreover, there may be a "ramp up" force on the CF spring, whereby the initial unfurling requires slightly less force (i.e. at small displacements of the spring). By attaching the spring very close to the flange it enables the spring to have reached effectively full force at the thinnest conventional ceiling thickness. For example, the spring may be operating in a constant force mode at a displacement of approximately 10 mm.

In another example, a kit of parts is provided. The kit of parts comprises a device as described in one of the above examples and one or more restraining members. Each restraining member may be inserted into a respective channel to urge the elastic member mounted in that channel into the restrained position.

In another example, a kit of parts is provided. The kit of parts comprises a mount for mounting a device in a ceiling aperture in a ceiling. The mount comprises a flange, one or more guides on the flange, and a respective elastic member associated with each guide. Each elastic member is configurable in a restrained position and an engaging position. The kit of parts further comprises a respective restraining member for each guide. Each guide is configured to receive the respective restraining member to urge the respective elastic member into the restrained position when the restraining member is inserted into the guide. The respective elastic member is released into the engaging position when the restraining member is removed from the guide. Each guide and respective restraining member comprise complementary engaging means that permit relative movement in an axis normal to the flange (perpendicular to the flange), restrict relative movement in other axes and restrict relative rotation, when the restraining member is inserted into the guide.

The kit of parts may further comprise a device, wherein the mount and the device comprise complementary fastening means. For example, the device may be fastened to the flange of the mount using screws.

Providing one or more elastic members that are restrained with restraining members allows the mount to be inserted easily into a ceiling aperture. This is because the elastic members have a low profile when they are held in the restrained position by the restraining members. Once the mount has been inserted into the ceiling aperture, the restraining members can be released and the elastic members will engage with the ceiling to hold the mount in the aperture. There is no requirement for the user to manually manipulate the elastic members. The user only needs to remove the one or more restraining members from the guides. The mount can therefore be installed easily and safely. Moreover, the mount can be removed easily by inserting restraining members back into the guides.

The elastic members may not extend laterally beyond the restraining member in the restrained position. Restraining members and elastic members therefore have a low profile on when the elastic members are in the restrained position, as compared to when the elastic members are in the unrestrained position. The mount can therefore be inserted into an aperture in the ceiling having appropriate dimension. Once the restraining members are removed, the mount is held in place by the elastic members and may not be removed from the aperture.

The mount may be configured so that in use, when the mount is inserted in the ceiling aperture and each restraining member is removed from the respective guide, the respective elastic member engages a rear side of the ceiling and exerts a force against the ceiling in a direction normal to the flange. The flange may extend laterally beyond the ceiling aperture to engage a front side of the ceiling and exert a force against the ceiling in a direction opposite the direction of the force exerted by the elastic members to brace the mount against the ceiling.

The mount may comprise two or more elastic members and respective guides. Where the mount comprises two or more guides, the elastic members may be arranged symmetrically (or evenly) around the mount. Alternatively, the elastic members may be distributed in a non-symmetric manner to correspond with any potential off-centre mass in a device to be retained by the mount. This provides balanced support of the device so that the device is held securely in the ceiling aperture. The mount may comprise three or four elastic members and these may be distributed in multiple orientations per side.

Each elastic member may be a constant force spring (CF spring). For example, the elastic member may be an extension type constant force spring. CF springs can beneficially provide a constant force, regardless of the displacement of the spring. The force used to hold the device is place is therefore determined only by the characteristics of the spring. The thickness of the ceiling does not affect the force applied by the spring.

Moreover, constant force springs can be unrolled into a restrained position in which they have a low profile. When the constant force springs are released, they roll up under their own bias. This means that the springs will present a wider profile in the unrestrained position compared to the restrained position. Thus the constant force springs engage with the upper surface of the ceiling when the restraining members are removed from their respective guides.

The mount may be used for mounting a device in a ceiling aperture in a ceiling. The device may be a lighting device including a lighting element. The device may be an audio device including a loudspeaker. Audio devices vibrate when in use and therefore more force may be required to mount such devices in the ceiling. In particular, it is desirable to retain a body of the device static relative to the panel in which it is mounted, despite movement or vibration caused by vibrating or moving elements in the device. Typically, forces 2 to 3 times the weight of the device or greater are desirable. Ideally the force is as high as is practical in order to provide a rigid clamping force to resist vibration and/or resonance.

Advantageously, by mounting the device using one or more elastic members, vibrations can be dampened. This can help to reduce loosening of physical static fixtures on the device. For example, screws in a speaker can sometimes be loosened by vibration of the speaker. By dampening the vibration of the device, the elastic members can help to prevent components in the device coming loose.

In another example, a method of mounting a device in an aperture is provided (for example, a ceiling aperture in a ceiling). The method comprises inserting a body of the device into the aperture, wherein the body of the device has a front end and defines a longitudinal axis perpendicular to the front end, wherein the device comprises a flange that extends laterally beyond the body at the front end. The method further comprises removing a restraining member from one or more channels along the body, wherein each of the channels extends from the front end of the body in the longitudinal direction, wherein the restraining member urges an elastic member mounted in the channel into a restrained position when the restraining member is in the channel, wherein removal of the restraining member from the channel releases the elastic member into an engaging position, wherein the respective elastic member extends laterally beyond the channel in the engaging position.

BRIEF DESCRIPTION OF THE SEVERAL VIEWS OF THE DRAWINGS

The present invention may be put into practice in a number of ways, and some specific examples will now be described with reference to the following drawings.

DESCRIPTION OF SPECIFIC EMBODIMENTS OF THE INVENTION

Figure 1:
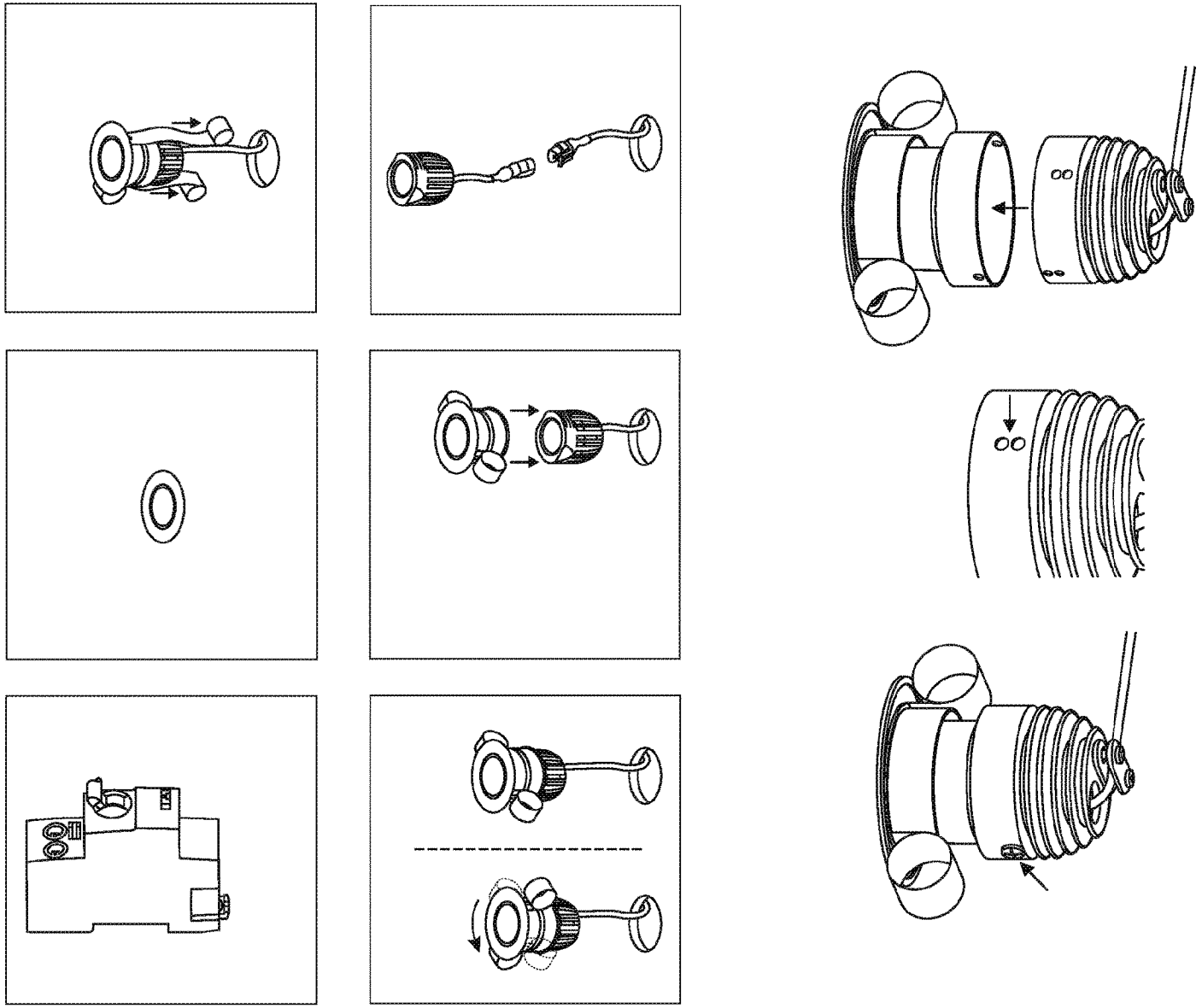
Figure 1 (Prior Art)
FIG. 1 provides an illustration of a prior art ceiling fitting.

As described above, prior art devices are mounted in the ceiling by manually unfurling the constant force springs and posting the partially unrolled springs through a hole in the ceiling. This is also illustrated in FIG. 1. Specifically, the springs are partially unfurled such as to lift the cylindrical part of the spring above the main diameter of the body such that they can then move closer to the centre axis of the body in order to allow posting through the ceiling. When the user releases the partially unfurled springs, the springs roll up and apply a force against the ceiling, thus bracing the device in place. This can be a fiddly task but does not present a significant danger to the user as the forces involved are relatively small. Moreover, because the user is not fully unfurling the spring, manual insertion is made easier. However, this mounting design compromises either the form of the body or its height. The body of the device also needs to have a gentle/large top radius when viewed in elevation (i.e. the device tapers smoothly towards the rear). This is because if the CF springs are deformed back harshly around a tight corner, they will take a permanent set, and be damaged such that the retention force is reduced.

In order to mount a device in a ceiling where the device includes a speaker, the unit must be held in place with a force approximately equal to 2 to 3 times the weight of the device. This at least partly due to vibration generated by the drive unit of the speaker.

A constant force spring capable of providing sufficient force for such a device will be difficult for a user to unfurl in the manner described above in relation to the prior art.

Injury may occur if a user attempts to partially unfurl the springs and post the coils through the ceiling aperture in this way.

In the case of the prior art system, the risk of injury is even more pronounced during removal of the device. The unit can be simply pulled out of the ceiling with the springs unfurling. During the unfurling action, the cylinder part of the CF spring is rotating. Therefore, it has the tendency to move towards and over the edge of the hole. At this point, unless constrained by the user's hand, the cylinder part of the CF spring will move at high speed towards the users other hand that is pulling on the flange. Significant dexterity is required to perform this task. Assistance may be required if the diameter of the body is too large for a single hand to simultaneously restrain both (or all) of the retention CF springs.

Delicate cosmetic or functional components may be contained within the flange/bezel element (typically antennae, microphones, light sensors etc. in a smart speaker). There is a risk of these components being damaged by this uncontrolled high speed retraction of the CF spring. In particular, the risk is more pronounced if the CF springs are attached very close to the flange/bezel (as is required for a device to be mounted in a thin panel).

To address these problems with prior art systems, a device having constant force springs to hold the device in place and blades to manipulate the constant force springs is provided in a specific example. The blades are removed to mount the device in the ceiling. The resulting device therefore provides a very low profile mounting solution that is easy and safe to use.

FIGS. 2A to 2D illustrate operation of an example device.

Figure 2A:
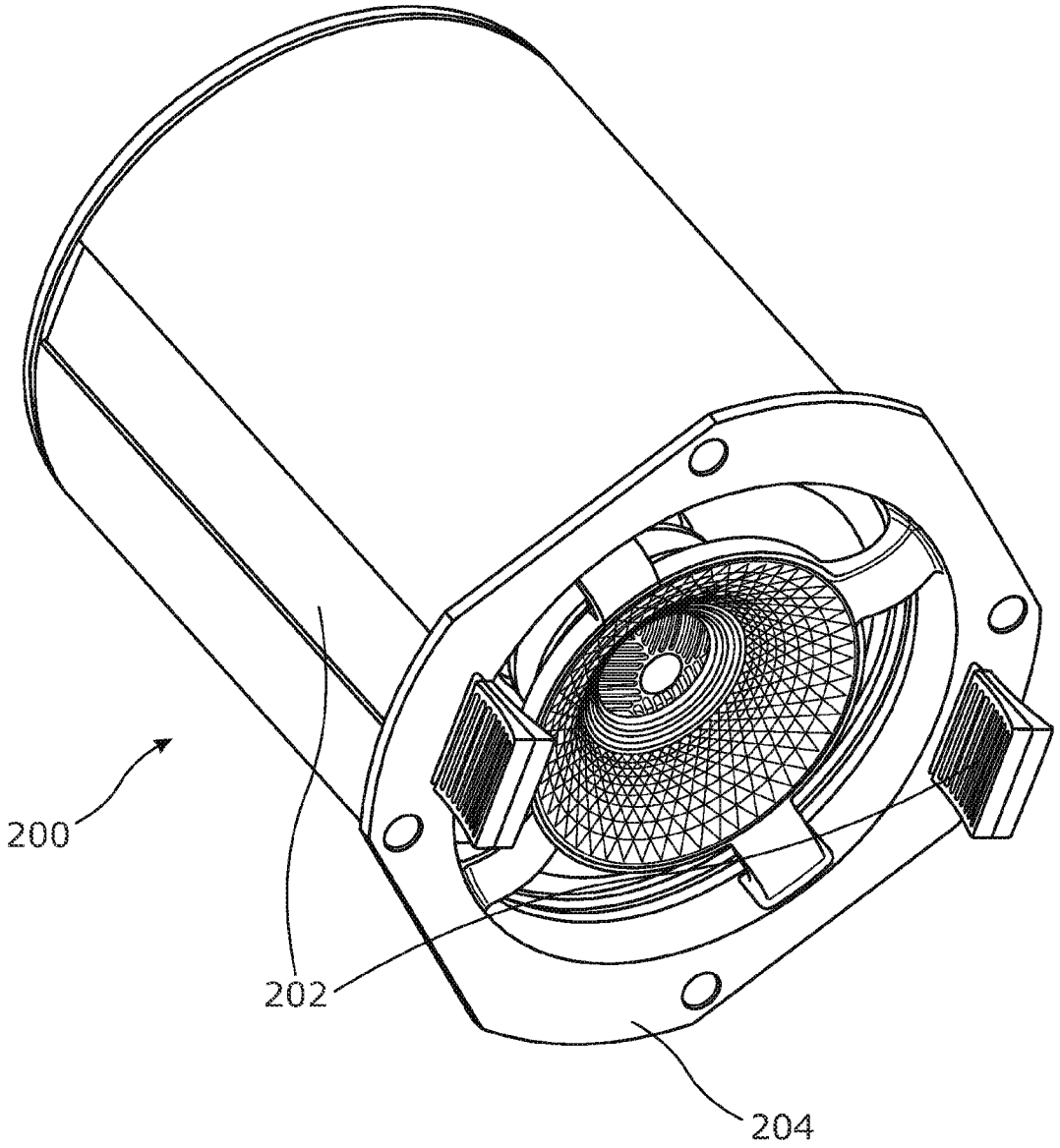
FIGS. 2A to 2D illustrate operation of a specific example device.

FIG. 2A shows an isometric view of a device (or unit) 200 according to a specific example. The device includes two removable blades (or restraining members) 202 that are used for mounting the device 200 in an aperture (or hole) in the ceiling. The device further includes a flange 204 at the front end of the device. When the device is mounted in the ceiling aperture, the flange 204 will sit flush with the ceiling. The device may be easily inserted into the ceiling aperture with the blades inserted.

Figure 2B:
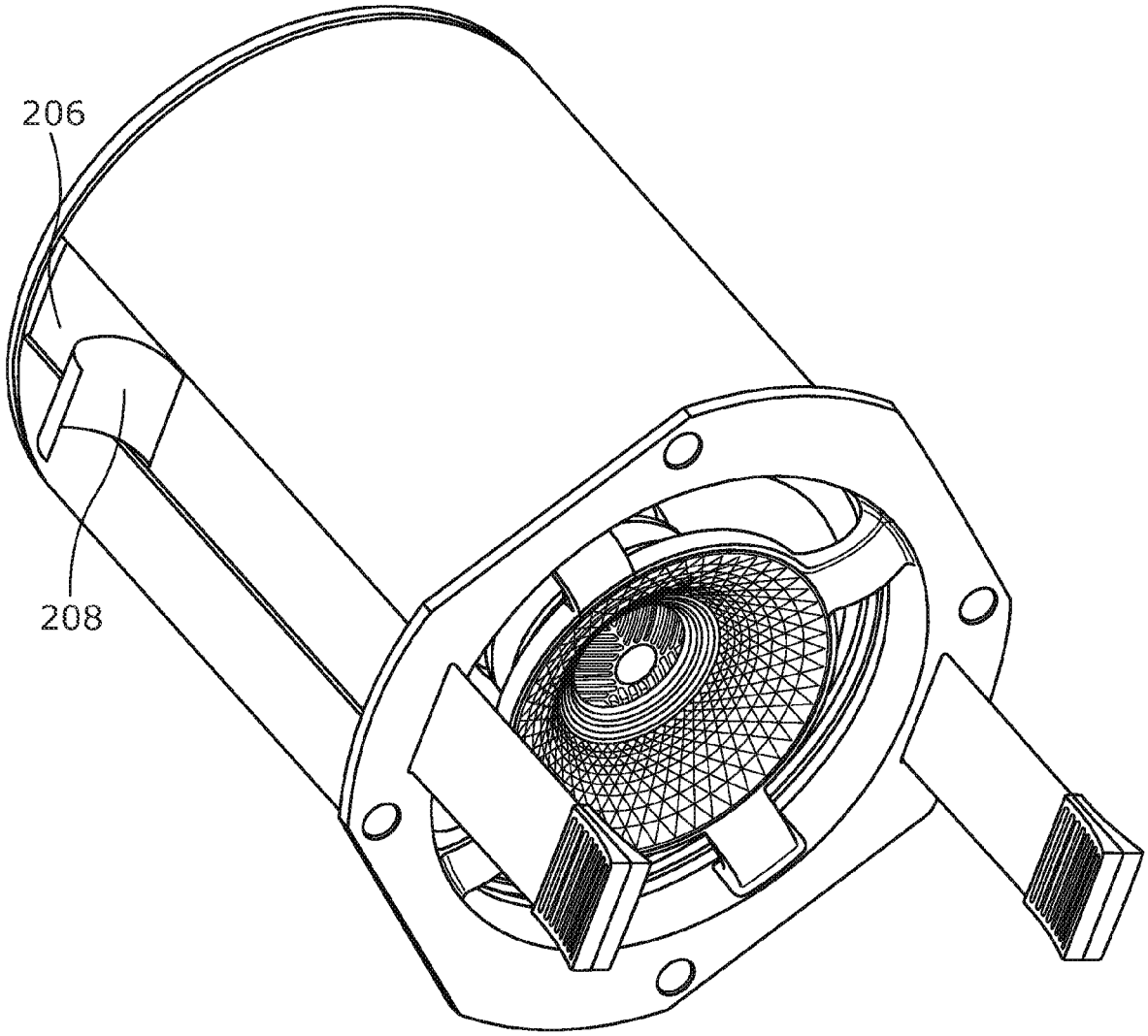

As shown in FIG. 2B, each of the blades 202 is held in a respective channel (or slot or guide) 206 in the body of the device. Each channel 206 further includes a respective constant force spring (or elastic member) 208. The constant force spring is held (e.g. mounted) in the channel (or guide). When the blades 202 are completely inserted into the channels 206, as shown in FIG. 2A, the constant force springs 208 are entirely restrained in the channels 206 in an unfurled position. Tabs at the end of the blades 202 project through the front bezel of the device.

As the blades 202 are pulled (slid) out of their channels 206, the constant force springs 208 are released. They are therefore no longer restrained in an unfurled (restrained) position and will roll up into an engaging position. Removal of the blades deploys the springs to clamp the unit into the ceiling.

Figure 2C:
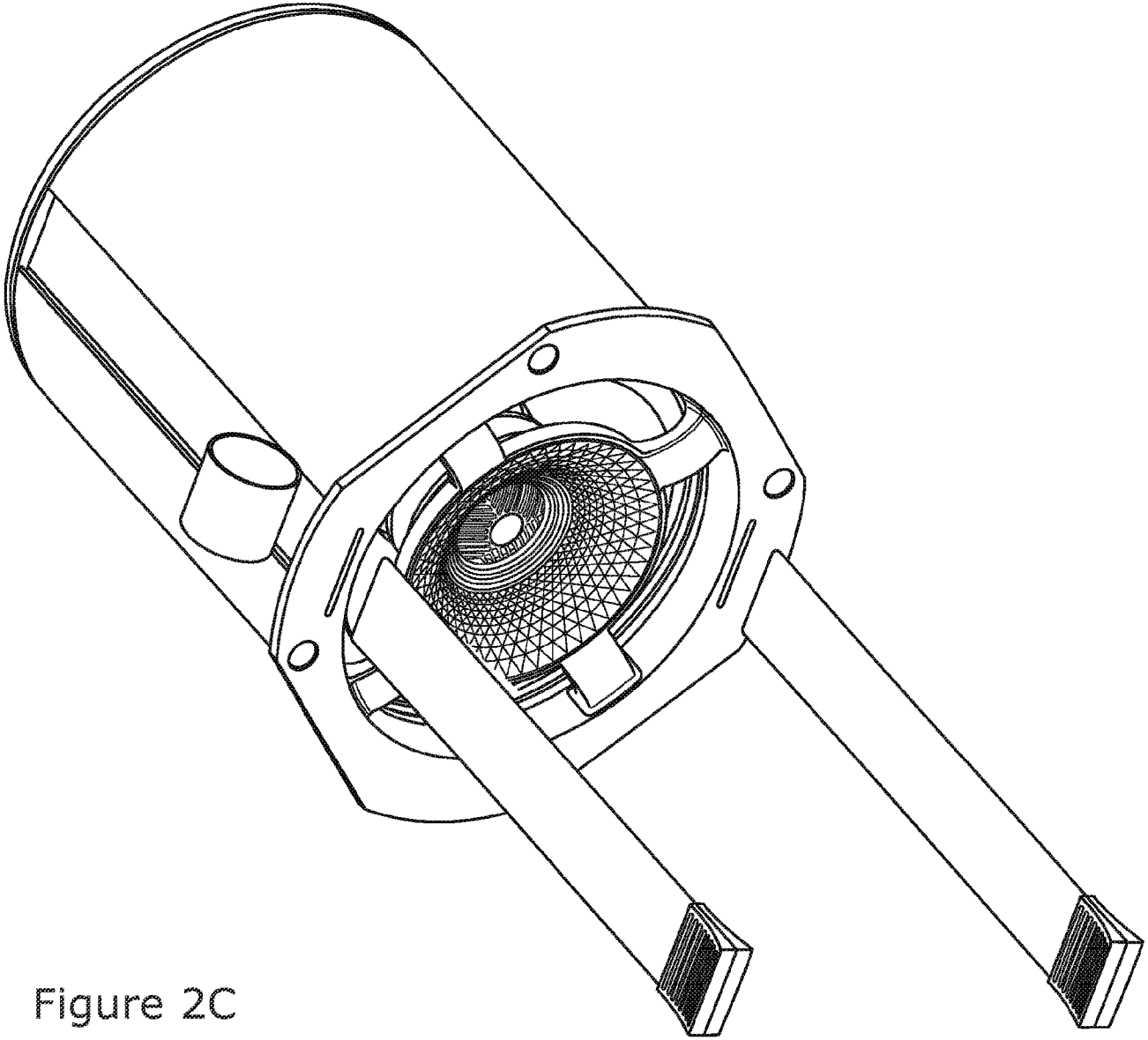
Figure 2D:
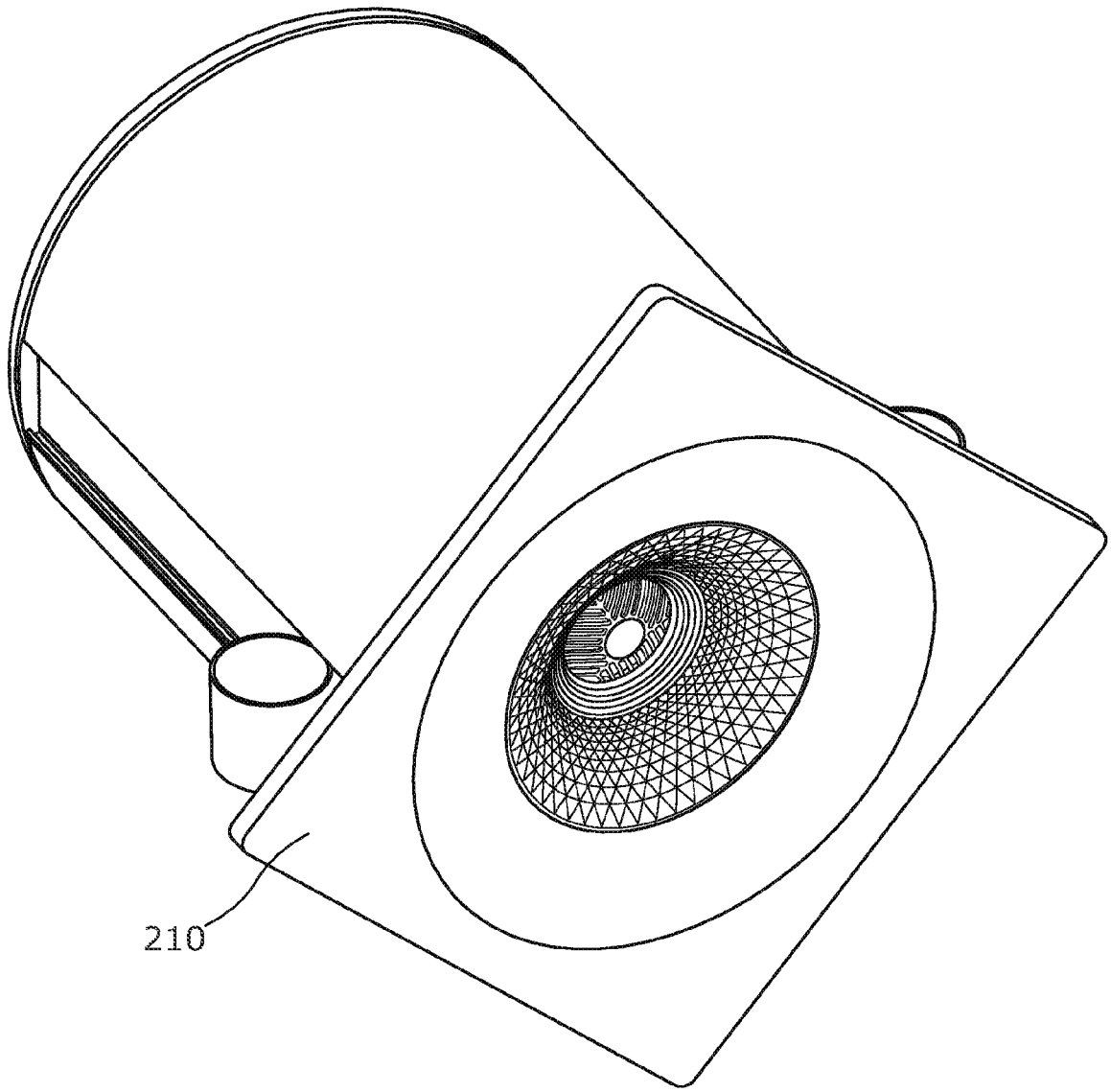

As shown in FIG. 2C, when the blades 202 are removed from their respective channels 206, the constant force springs 208 are rolled up in the engaging position. In this position, the outer diameter of the rolled part of the CF spring engages the top part of the ceiling (not shown).

Once the blades 202 have been completely removed, a cosmetic cover 210 may be placed over the flange 204. This may be achieved using a clip and/or magnetic mechanism, for example. The flange/bezel may itself be cosmetic. This portion and could have a visible slot or and an elastomeric or moving element to conceal the removal slot if desired.

Figure 3:
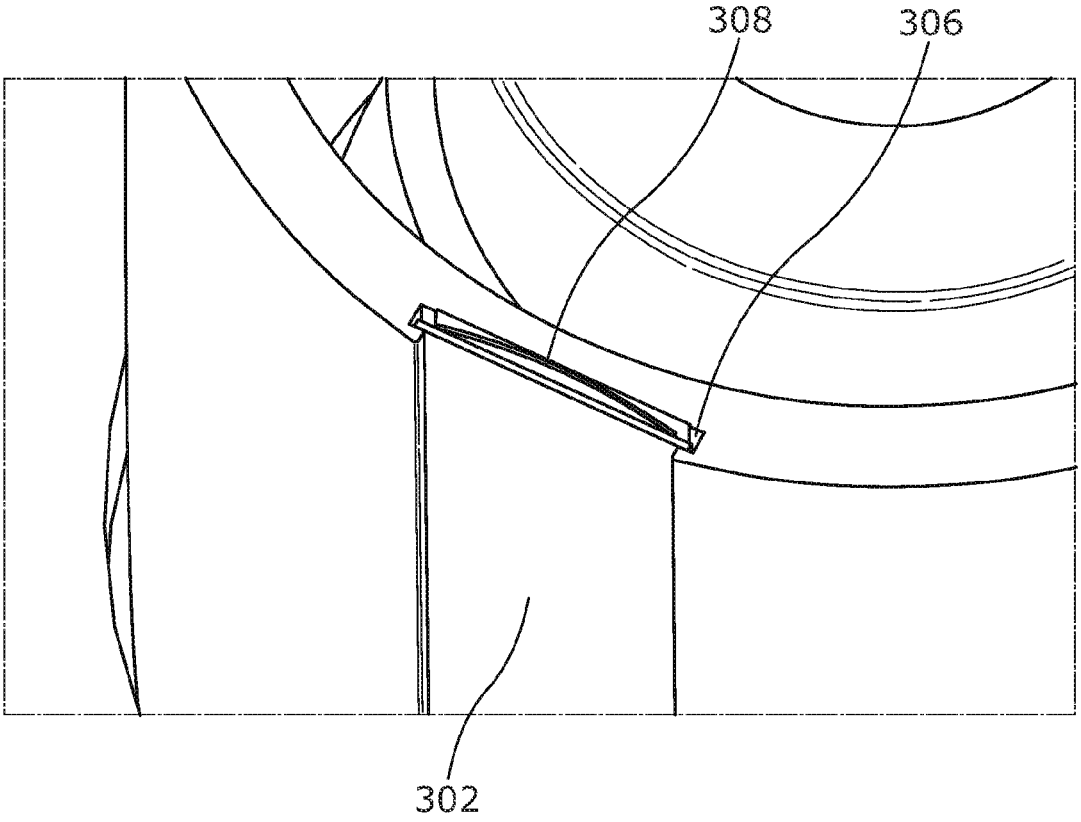
FIG. 3 shows a detailed cutaway isometric view of the mounting mechanism in the restrained position.

FIG. 3 shows a detailed cutaway isometric view of the device. As shown in FIG. 3, the mounting mechanism is in the restrained position. In this configuration, the blade 302 is inserted into the channel 306. The presence of the blade 302 in the channel 306 causes the constant force spring 308 to be restrained completely within the channel in the unrolled (or loaded) position. As a result, the device may be easily inserted into a hole in the ceiling. When the device is in position, the blades may be removed and the spring rolls up to capture the ceiling, as shown in FIG. 4.

If a user wishes to remove the unit from the ceiling, they can re-insert the blades to get the springs out of the way. The device can then be slid out of the aperture in the same way it was inserted, without risk of injury from unrestrained springs.

Figure 4:
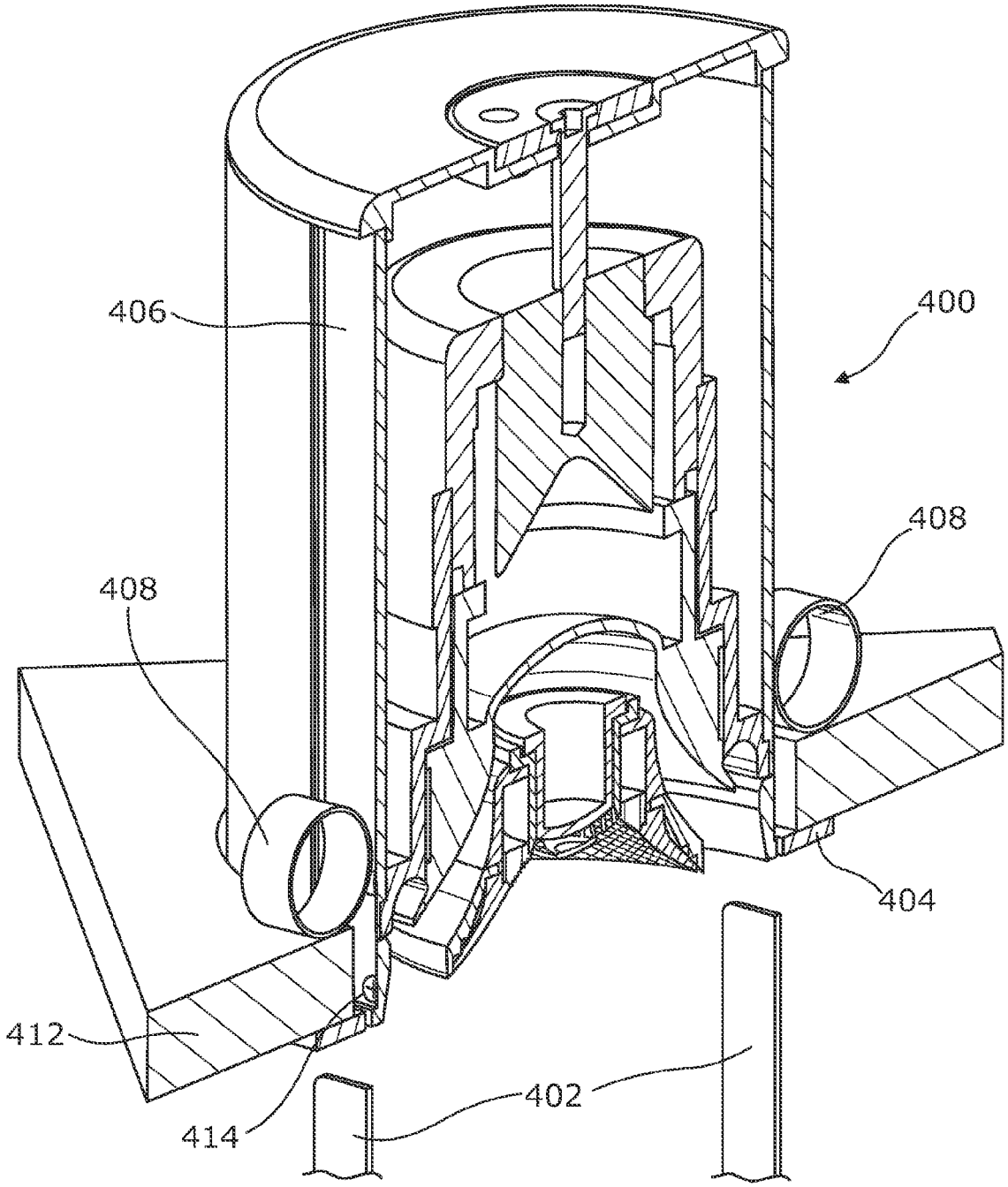
FIG. 4 shows an isometric cutaway view of an example device including the mounting system in the engaging position.

FIG. 4 shows an isometric cutaway view of a device 400 according to a specific example. The mounting system is shown in the engaging position. As can be seen from FIG. 4, the blades 402 have been removed from the channels 406 and the flange 404 is flush with the ceiling 412. The constant force springs 408 are in the engaged position and are applying a force against the opposite side of the ceiling 412 to the flange 404. The device is thereby held in place with sufficient force.

The constant force springs 408 are held in place in the channels by a mounting screw 414.

Figure 5:
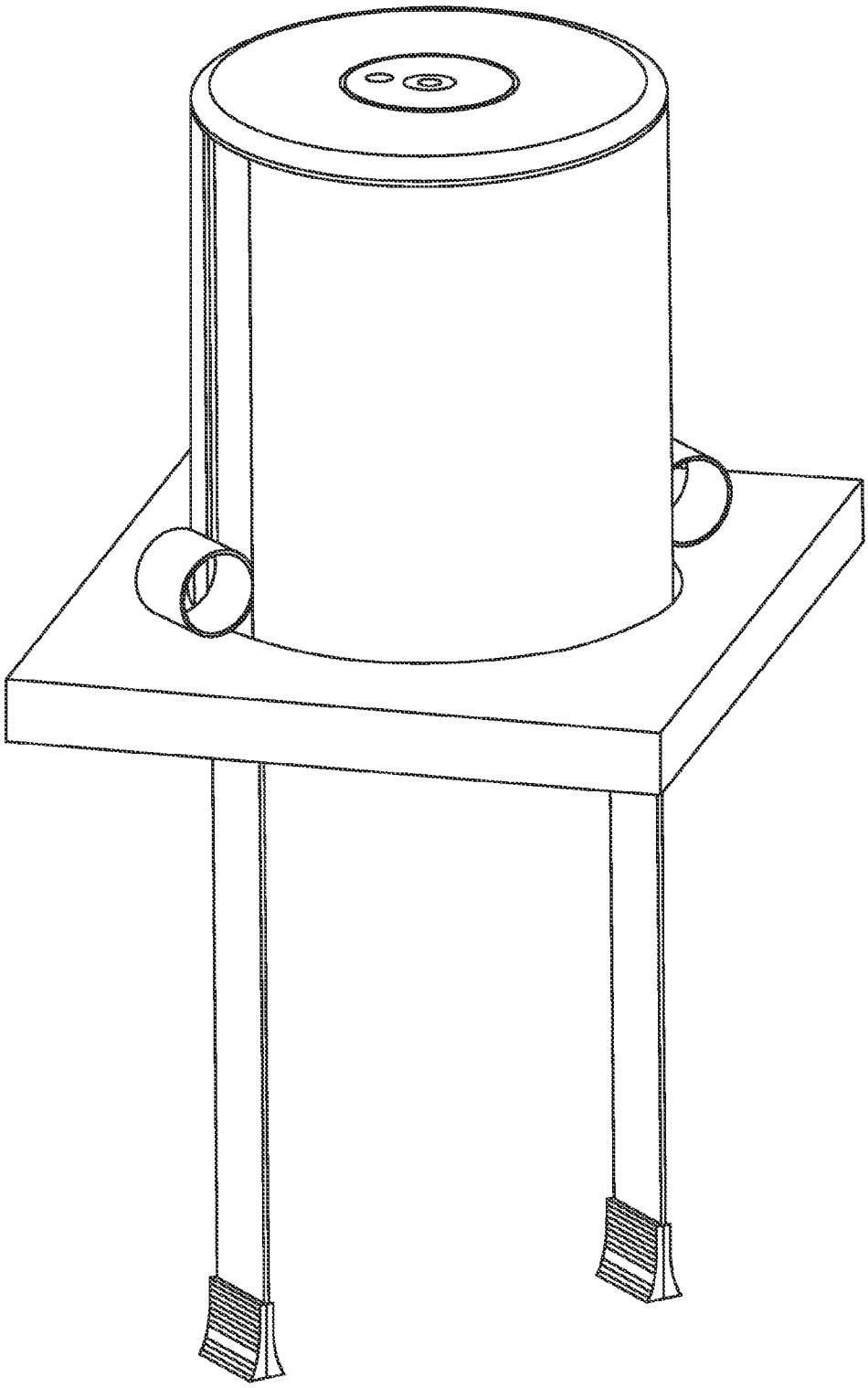
FIG. 5 shows an isometric view of an example device including the mounting system in the engaging position.

FIG. 5 shows an isometric view of a device according a specific example. The mounting system is shown in the engaging position. In this illustration, the restraining members (removal blades) have been completely removed from the slots (not shown).

Figure 6:
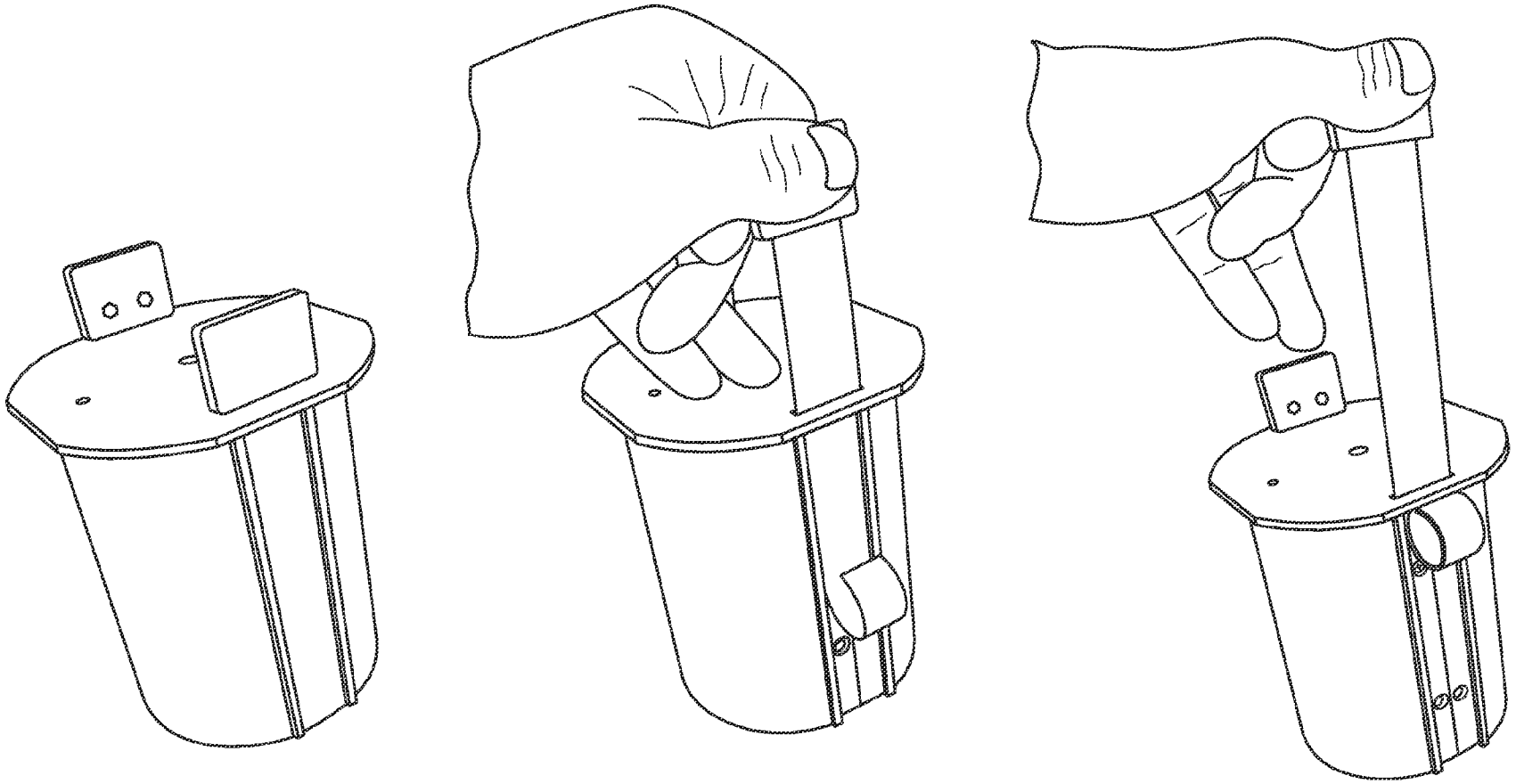
FIG. 6 shows images of a prototype (demonstration) rig as another specific example.

FIG. 6 shows images of a prototype (demonstration) rig in accordance with a specific embodiment of the present invention.

As can be seen from FIG. 6, the channel may be external to the body of the device and affixed to the body, rather than being integrated into the body of the device.

Figure 7A:
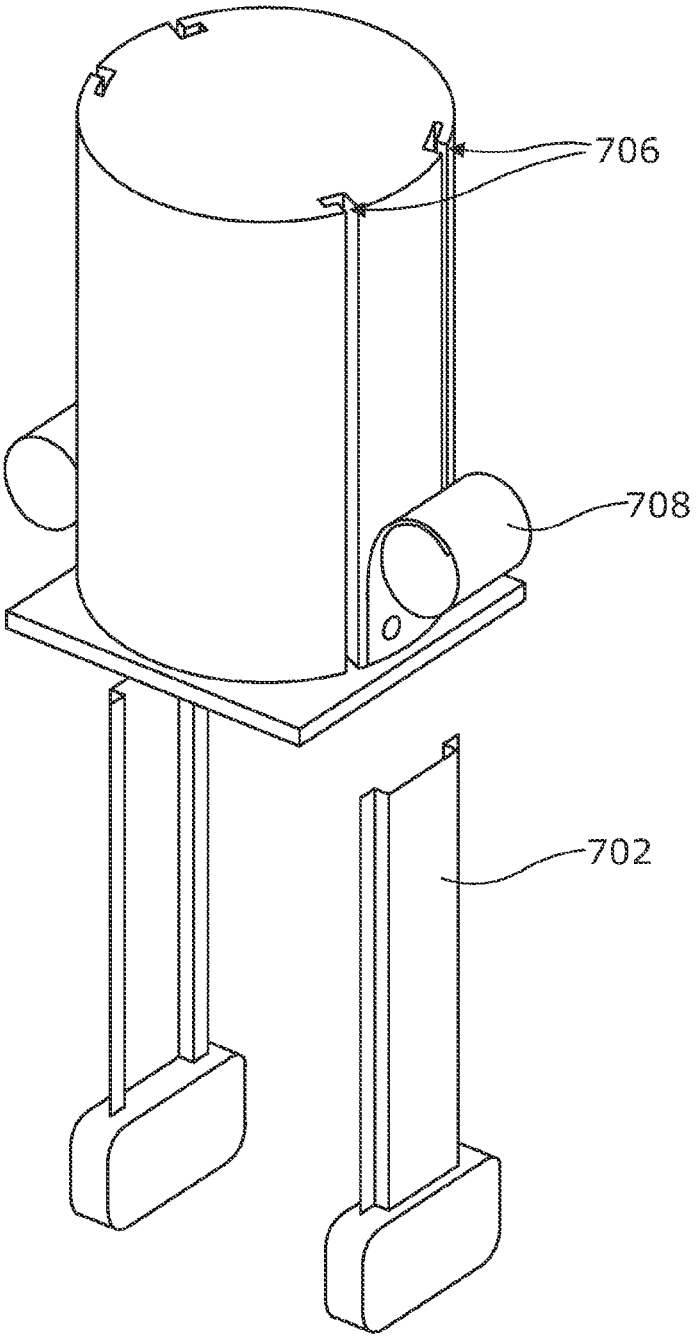
FIGS. 7A and 7B illustrate alternative example devices.

The examples described and illustrated above include an elastic member mounted within the channel. The channel is in the form of a "T slot" in order to allow retention of the restraining means and also to provide a space in which the elastic member sits when in the restrained position. In this way, the channel is able to guide and support the restraining member. The channel provides support to the restraining member so that it is stiff enough to restrain the elastic member (to overcome the force of the elastic member), whilst being made from a relatively thin material. However, the elastic member does not need to be mounted in a channel. FIG. 7A, illustrates an alternative solution. In this example, the CF spring 708 is mounted on the outside of the body, rather than in the channel. Two smaller channels 706 are provided on either side of the CF spring 708 to retain the restraining means (removal tool) 702. In the example illustrated in FIG. 7A, these are "L"-shaped channels and the removal tool/blade has a "top hat"-type cross-section profile. The channels each receive a portion of the removal tool and provide support so that the tool can be inserted into the channels and used to restrain the CF spring.

Figure 7B:
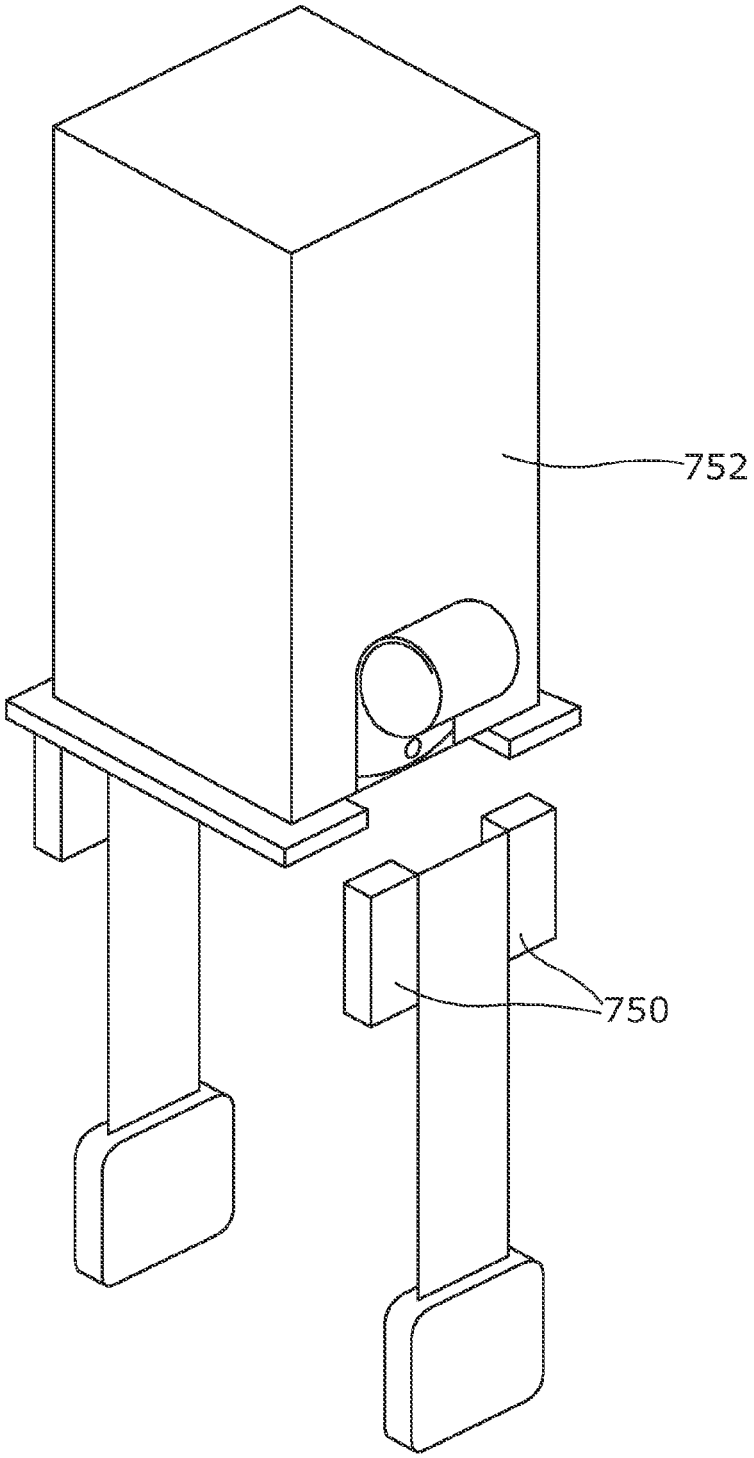

FIG. 7B illustrates a further alternative. In this example, there is no channel acting as a guide. The guide is provided by magnetic components 750 on the body and/or removal tool and an opening in the bezel into which the tool is inserted. For example, the device may have a steel or ferritic body or local ferritic strips on the body 752. The removal tool (restraining means) may have magnets 750 on either side of the blade part. The force provided by the magnets is sufficient to brace the tool against the body and restrain the CF spring.

The examples described above illustrate separate removal tools (restraining members) for each spring. As a further alternative, the elastic members (springs) could be unfurled using a single tool with all of the blades connected together at the front end of the device. For example, where there are two CF springs (one on either side of the device) the removal tool may be "U"-shaped. In this case, channels may not be required to brace the removal tool against the body of the device because the forces required to restrain the springs are approximately equal and opposite. However, the restraining member would need to be thicker to provide rigidity to the restraining member to counteract the bending moment applied by each of the CF springs to each blade of the removal tool.

The examples disclosed in this application advantageously provide a low-profile mounting solution. The physical volume of the device is therefore not significantly increased by applying this mounting system. Where the device is a speaker device, acoustic performance is dependent on the physical volume of the cabinet (body) of the device. Therefore, acoustic performance of speakers mounted using this solution can be maintained, without significantly increasing the size of the hole in the ceiling. This also avoids increasing the size of the cosmetic cover.

Figure 8:
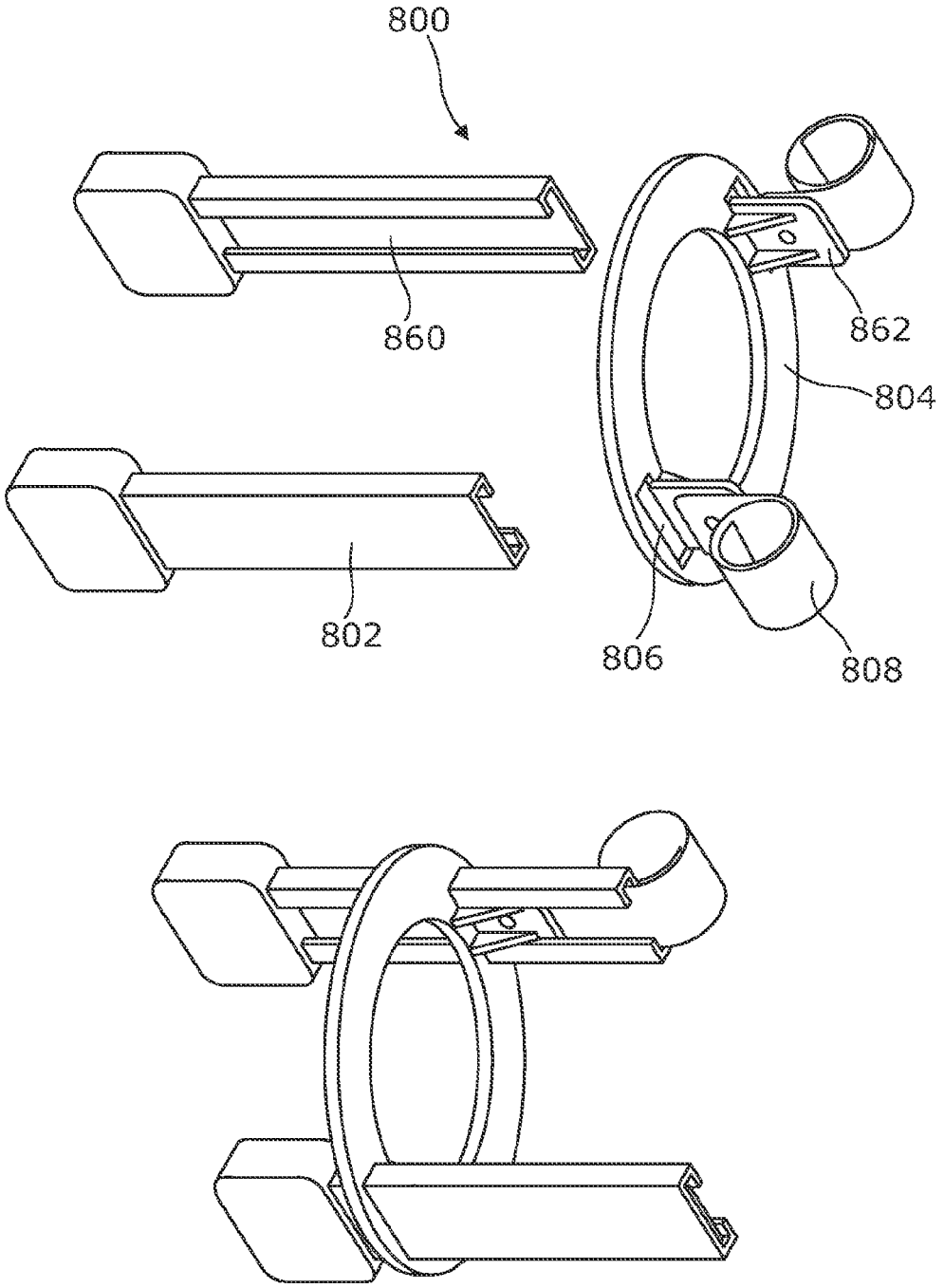
FIG. 8 illustrates a mount for mounting a device.

FIG. 8, illustrates a mounting system 800 for mounting a device in a ceiling aperture in a ceiling. This specific example includes a flange 804 having two slots 806. The slots are arranged to receive restraining members 802. The restraining members each comprise a channel 860. Adjacent the slots are support members 862. The support members are used to mount the elastic members.

When the restraining members are inserted into a respective slot, the support member is held inside the channel of the restraining member. The slot and support members restrict the movement of the restraining member so that the restraining member can be slid in and out of the slot but prevent the restraining member from moving in other directions or rotating when the support member is inside the channel. In this way, the restraining member can be used to urge the elastic member from the engaging position into the restrained position as the restraining member is slid into the slot and the support member is slid into the channel.

In a specific example, the tool (restraining member) provides the guidance channel and edge retention required to unfurl the constant force spring. The tool is in the form of an elongated "C" section channel such that the tool engagement at the edges of the constant force spring provides a retention against which the opposite flat of the "C" can act to unroll the spring. As with the other examples, the tools may be separate/individual per constant force spring or alternatively joined together at the front/proximal end to make a single double or multi-armed tool.

This example can effectively operate in free space, without the need for the device (for example, luminaire or loudspeaker) to have a body or can to carry the guidance channels. The mount can be used to mount any device that is attached to the mount. For example, the device may be fastened to the flange of the mount.

Figure 9:
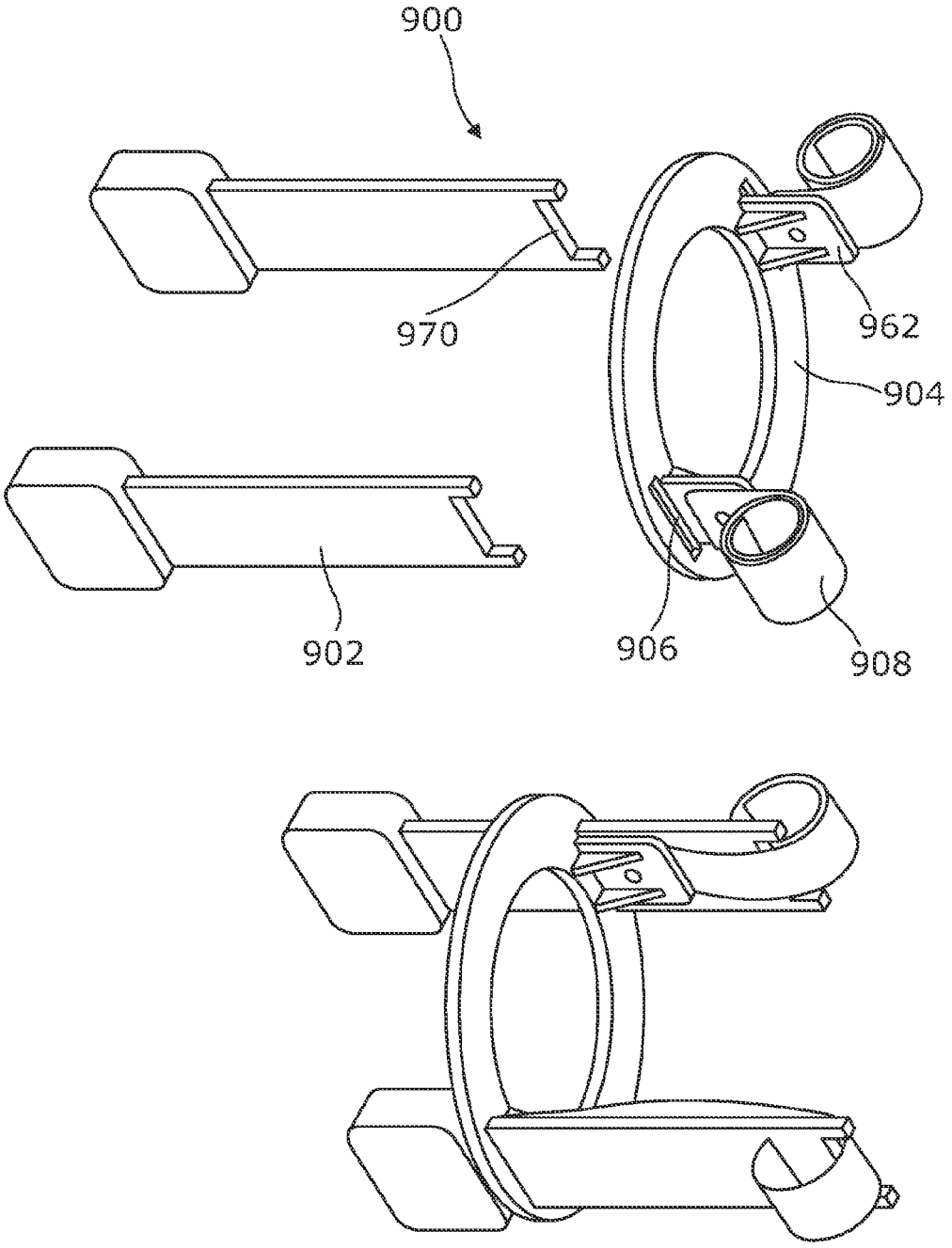
FIG. 9 illustrates an alternative mount for mounting a device.

FIG. 9, illustrates a mounting system 900 for mounting a device in a ceiling aperture in a ceiling. This specific example includes a flange 904 having two slots 906. The slots are arranged to receive restraining members 902. The restraining members each comprise a notched end 970. Adjacent the slots are support members 962. The support members are used to mount the elastic members.

When a restraining member is inserted into a slot, the CF coil spring is held inside the notch of the restraining member. The notch and CF coil spring restrict the movement of the restraining member so that the restraining member can be slid in and out of the slot but is prevented from moving in other directions or rotating when inside the slot. In this way, the restraining member can be used to unroll the CF coil spring as the restraining member is slid into the slot.

In a specific example, the tool (restraining member) provides guidance for the constant force spring using a notch just wider than the CF spring on the tool's the top edge.

In this variation, the tool tip is effectively held against the unfurled portion of the spring by the cylindrical portion that is still rolled up; the tool must, therefore, be matched in length to the spring such that a "depth stop" always limits the tool insertion to leave about half a "turn" of the spring curled over the top of the tool to retain it in an extended condition. Over insertion of a tool without a depth stop would result in the spring loosing retention on the tool tip and recoiling in an uncontrolled fashion.

The tool is guided/retained by the "roll" until it reaches the end of the spring. At this point, the coil of the spring slips over the end of the tool and is no longer retained. Therefore, the depth of the tool insertion is limited (e.g. by the length of the tool) to a point where the spring is not fully unrolled. This example therefore adds more than a few millimetres to the diameter of whatever the can etc is as you still have a "spring roll" per side.

As with the example of FIG. 8, the example of FIG. 9 can effectively operate in free space, without the need for the device (for example, luminaire or loudspeaker) to have a body or can to carry the guidance channels. The mount can be used to mount any device that is attached to the mount. For example, the device may be fastened to the flange of the mount.

Many of the features described with respect to the mountable device can equally be applied to the mounting system of FIG. 8 or FIG. 9, as will be appreciated by the skilled person. Moreover, variations described with respect to the device are equally applicable to the mounting system. For example, the mounting systems are described as having two slots but variations including three, four or more slots are also possible.

Figure 10:
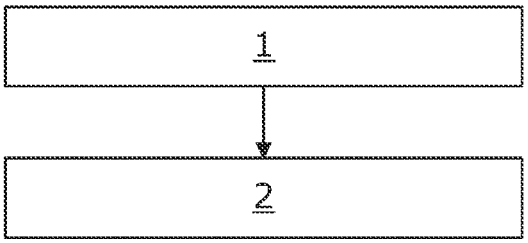
FIG. 10 is a flow chart illustrating a method of mounting a device in an aperture.

FIG. 10 is a flow chart illustrating a method of mounting a device in an aperture. At step 1, a body of the device is inserted into the aperture. The body of the device has a front end and defines a longitudinal axis perpendicular to the front end. The device comprises a flange that extends laterally beyond the body at the front end. At step 2, one or more restraining members are removed from one or more respective guides provided on the body. Each restraining member urges a respective elastic member mounted on the body into a restrained position when the restraining member is inserted into the guide. Removal of the restraining member from the guide releases the respective elastic member into an engaging position. Each elastic member extends laterally beyond the body in the engaging position.

Alternatives and Variations

This system is especially useful where elastic members are required that apply more force than those found in standard lighting fittings (e.g. in mounted speaker devices and combined lighting and speaker devices). However, the system may also be useful to simplify installation of standard lighting fittings (and other devices to be mounted in a ceiling) with elastic members that apply smaller forces. The type and number of elastic members may be selected to apply a suitable force depending on the device to be mounted.

Whilst the above description describes mounting devices in ceiling apertures, the system could also be used to mount devices in apertures in walls or generally any flat panel with a cavity behind. Where the device is mounted in a wall, only one spring may be required to brace the device in position (e.g. at the top of the device). Where the device is mounted in the ceiling, two or more springs may be required to distribute the load more evenly.

Whilst the specific examples described above include constant force springs, other types of elastic members may be used.

The specific examples described above include two blades, channels and springs. However, variations with more blades, channels and springs are possible. Additional springs could be provided to increase the force provided by the mounting system. In some devices, only one spring may be required. It is advantageous to provide more than one spring so that the springs can be mounted symmetrically around the device and thus provide a secure mounting system.

The blades may be manufactured from steel, plastic or other suitably rigid material.

The channel along the body of the device (the outer casing or cabinet of the device) may be extruded into the body of the device. Alternatively, the channel may be formed by an external structure affixed to the body of the device.

Springs are shown mounted in their respective channel using a single screw. However, more than one screw may be used to mount each spring. Other methods of mounting the spring in the channel may be used (e.g. gluing, riveting, welding, clipping or clamping).

Whilst the description generally relates to lighting and loudspeaker devices, the mounting system could be applied to any device. The system is generally applicable to any device to be mounted in a ceiling, wall or other flat panel. For example, the device may include various combinations of lighting, audio and other electronic components. The system is also suitable for mounting alarms, smoke alarms, $CO_2$ detectors, temperature sensors, security cameras and the like.

The invention claimed is:

1. A device suitable for mounting in a ceiling aperture in a ceiling, the device comprising:

a body having a front end and defining a longitudinal axis perpendicular to the front end;

a flange that extends laterally beyond the body at the front end;

one or more elastic members mounted on the body, each elastic member being configurable in a restrained position and an engaging position; and a respective guide on the body associated with each elastic member, each guide being configured to receive a restraining member that urges the respective elastic member into the restrained position when the restraining member is inserted into the guide, and wherein the respective elastic member is released into the engaging position when the restraining member is removed from the guide, wherein each elastic member extends laterally beyond the body in the engaging position, wherein each guide comprises at least one of:

a) a channel along the body, which extends from the front end of the body in a longitudinal direction along said longitudinal axis; and b) a slot configured to receive a restraining member, and a support member adjacent the slot configured to engage a channel of the restraining member.

2. The device of claim 1, wherein each elastic member does not extend laterally beyond the restraining member in the restrained position.

3. The device of claim 1, wherein each guide comprises a channel along the body, wherein each channel is configured to receive the respective restraining member, and wherein each elastic member is mounted in the channel of the respective guide and Wherein each elastic member lies in the respective channel so that it does not extend laterally beyond the body in the restrained position.

4. The device of claim 3, wherein each channel is a retention channel comprising an overhanging portion on one or both sides of the channel, wherein the overhanging portion is configured to retain the restraining member in the channel when the restraining member is inserted into the channel.

5. The device of claim 3, wherein each channel is formed as an integral part of the body of the device.

6. The device of claim 3, wherein each channel is external to the body of the device.

7. The device of claim 1, wherein each guide comprises a pair of channels along the body, wherein the channels in each pair of channels are located on either side of the respective elastic member, and wherein each channel of each pair of channels is configured to receive a portion of the respective restraining member.

8. The device of claim 1, wherein each guide comprises one or more magnetic portions on the body of the device.

9. The device of claim 8, wherein each guide is configured to receive a restraining member comprising one or more magnets, wherein each of the magnetic portions is attracted to a respective magnet when the restraining member is inserted into the guide.

10. The device of claim 1, wherein the device is configured so that in use when the body of the device is inserted in the ceiling aperture and each restraining member is removed from the respective guide:

each elastic member engages a rear side of the ceiling and exerts a force against the ceiling in the longitudinal direction; and the flange extends laterally beyond the ceiling aperture to engage a front side of the ceiling and exerts a force against the ceiling in a direction opposite the direction of the forces exerted by the elastic members to brace the device against the ceiling.

11. The device of claim 1, wherein the device comprises two or more elastic members and respective guides.

12. The device of claim 1, wherein each elastic member is a constant force spring.

13. The device of claim 1, wherein the device is a lighting device including a lighting element.

14. The device of claim 1, wherein the device is an audio device including a loudspeaker.

15. The device of claim 1, further comprising a respective screw, rivet, pin or fastener used to fasten each elastic member to the body.

16. The device of claim 15, wherein each screw, rivet, pin or fastener is located at or towards the front end of the body.

17. A kit of parts comprising the device of claim 1 and one or more restraining members.

18. A method of mounting the device of claim 1 in an aperture, the method comprising:

inserting the body of the device into the aperture; and removing one or more restraining members from one or more respective guides provided on the body.

19. A kit of parts comprising:

a mount for mounting a device in a ceiling aperture in a ceiling, the mount comprising:

a flange;

one or more guides on the flange; and a respective elastic member associated with each guide, each elastic member being configurable in a restrained position and an engaging position; and a respective restraining member for each guide, wherein each guide is configured to receive the respective restraining member to urge the respective elastic member into the restrained position when the restraining member is inserted into the guide, wherein the respective elastic member is released into the engaging position when the restraining member is removed from the guide, wherein each guide and respective restraining member comprise complementary engaging means that permit relative movement in an axis normal to the flange, restrict relative movement in other axes and restrict relative rotation, when the restraining member is inserted into the guide, wherein each guide comprises at least one of:

a) a channel along a body of the device, the body having a front end and defining a longitudinal axis perpendicular to the front end, wherein the channel extends from the front end of the body in a longitudinal direction along said longitudinal axis; and b) a slot configured to receive a restraining member, and a support member adjacent the slot configured to engage a channel of the restraining member.

* * * * *